US011302166B2

(12) United States Patent
Patel

(10) Patent No.: US 11,302,166 B2
(45) Date of Patent: Apr. 12, 2022

(54) PHOTO-ELECTRIC SMOKE DETECTOR USING SINGLE EMITTER AND SINGLE RECEIVER

(71) Applicant: Carrier Corporation, Palm Beach Gardens, FL (US)

(72) Inventor: Vipul H. Patel, Sarasota, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 16/949,421

(22) Filed: Oct. 29, 2020

(65) Prior Publication Data

US 2021/0166542 A1 Jun. 3, 2021

Related U.S. Application Data

(60) Provisional application No. 62/942,303, filed on Dec. 2, 2019.

(51) Int. Cl.
*G08B 17/107* (2006.01)
*G08B 29/14* (2006.01)

(52) U.S. Cl.
CPC ..... *G08B 17/107* (2013.01); *G08B 29/145* (2013.01)

(58) Field of Classification Search
None
See application file for complete search history.

(56) References Cited

U.S. PATENT DOCUMENTS 4,004,288 A * 1/1977 Webb, Jr. ..... G08B 17/11 340/636.15
4,103,997 A 8/1978 Araki et al.
4,321,466 A * 3/1982 Mallory ..... G01N 21/4785 340/630
4,595,914 A * 6/1986 Siegel ..... G08B 17/11 340/529
5,486,811 A * 1/1996 Wehrle ..... G08B 17/00 340/522
5,576,697 A * 11/1996 Nagashima ..... G08B 17/107 250/574
5,596,314 A * 1/1997 Goldstein ..... H01M 50/213 429/96
5,945,924 A * 8/1999 Marman ..... G08B 17/10 340/928
6,064,064 A * 5/2000 Castleman ..... G08B 17/12 250/339.05

(Continued)

FOREIGN PATENT DOCUMENTS

EP 3413279 A1 12/2018

*Primary Examiner* — Curtis J King
(74) *Attorney, Agent, or Firm* — James A. Edwards

(57) ABSTRACT

A smoke detector with an emitter and a receiver defining an angular distance there between less than 90°, the angular distance between the emitter and the receiver generating a back scatter effect, and a method of operating the smoke detector are provided. The smoke detector includes a housing defining a chamber for receiving ambient materials, an emitter configured to emit light (ex. infrared light or any light in the visible spectrum, such as blue light) into the chamber, a receiver configured to receive light reflected from the ambient materials in the chamber and generate output signals, and a controller configured to receive output signals from the receiver and determine whether a current condition of the chamber indicates a need to trigger an alarm.

15 Claims, 6 Drawing Sheets

(56) References Cited

U.S. PATENT DOCUMENTS 7,969,296 B1 * 6/2011 Stell ..... G08B 17/117 340/522
7,978,087 B2 * 7/2011 Siber ..... G08B 29/24 340/630
8,004,416 B2 * 8/2011 Bradley, Jr. ..... G08B 17/10 340/693.6
8,077,046 B1 * 12/2011 Wong ..... G08B 17/107 340/577
9,677,986 B1 * 6/2017 Baldwin ..... G01N 15/06
2001/0038338 A1 * 11/2001 Kadwell ..... G08B 29/24 340/630
2003/0011770 A1 * 1/2003 Cole ..... G08B 17/107 356/338
2004/0056765 A1 * 3/2004 Anderson ..... A62C 99/0045 340/522
2004/0063154 A1 * 4/2004 Booth ..... G08B 29/26 435/7.1
2005/0057355 A1 * 3/2005 Barrieau ..... G08B 29/185 340/529
2008/0211678 A1 * 9/2008 Andres ..... G08B 17/00 340/603
2008/0218364 A1 * 9/2008 Mizuo ..... G08B 17/107 340/630
2009/0009345 A1 * 1/2009 Conforti ..... G08B 17/107 340/627
2009/0212959 A1 * 8/2009 Suber, III ..... G08B 25/08 340/603
2010/0271219 A1 * 10/2010 Lang ..... G08B 17/10 340/628
2011/0018726 A1 * 1/2011 Gonzales ..... G08B 29/185 340/628
2011/0068936 A1 * 3/2011 Shimada ..... G08B 17/113 340/584
2011/0188039 A1 * 8/2011 Aoyama ..... G01N 21/53 356/338
2012/0092176 A1 * 4/2012 Aebersold ..... G08B 17/107 340/630
2013/0201022 A1 * 8/2013 Brigham ..... G08B 17/107 340/584
2013/0334417 A1 * 12/2013 Lewiner ..... G01N 15/0656 250/338.5
2015/0029320 A1 * 1/2015 Wieser ..... H04N 5/2252 348/77
2015/0228171 A1 * 8/2015 Aebersold ..... G08B 17/107 340/630
2015/0310717 A1 * 10/2015 Al-Farra ..... G08B 17/12 340/628
2015/0371514 A1 * 12/2015 Bonisch ..... G08B 17/103 340/630
2015/0379846 A1 * 12/2015 Bressanutti ..... G08B 17/113 340/630
2016/0153905 A1 * 6/2016 Allemann ..... G01N 21/53 356/338
2016/0313243 A1 * 10/2016 Dittrich ..... G01N 15/1434
2017/0046935 A1 * 2/2017 Allemann ..... G08B 17/103
2018/0350220 A1 * 12/2018 Gonzales ..... G08B 17/113

* cited by examiner

PHOTO-ELECTRIC SMOKE DETECTOR USING SINGLE EMITTER AND SINGLE RECEIVER

CROSS REFERENCE TO A RELATED APPLICATION

The application claims the benefit of U.S. Provisional Application No. 62/942,303 filed Dec. 2, 2019, the contents of which are hereby incorporated in their entirety.

BACKGROUND

A smoke detector is a device that detects smoke and issues an alarm. A photo-electric smoke detector is a type of smoke detector that works based on light reflection principles.

Conventional photo-electric smoke detectors include at least one light emitter, at least one light receiver, and an optic chamber with the emitter and receiver being in a forward light scattering configuration. When there is no smoke in the optic chamber, and the optic chamber is empty or mostly empty, the light receiver typically receives a small amount of light reflected from the chamber surfaces. On the other hand, when smoke is present in the optic chamber, the light receiver receives more light due to the light being reflected from the smoke particles. When an amount of light received by the receiver exceeds a certain threshold, an alarm is triggered.

Conventional photo-electric smoke detectors are able to detect the large-size particles that are produced during the "flaming foam fire" test and in real-world fires that typically generate large particles and present hazards to life and property, such as wood fires and other flammable materials fires, but often produce false alarms with smoke-producing and particle-producing events deemed less hazardous such as cooking fires and steam. Typically conventional photo-electric smoke detectors produce false alarms because they are not able to discriminate between large-size non-smoke particles, such as steam clouds, dust clouds, etc., and small-size non-smoke particles that are generated by certain types of cooking scenarios. That is, conventional photo-electric smoke detectors are not capable of determining when small-size non-smoke particles are generated by safe activities, such as broiling hamburgers, toasting bread, etc., and thus permit false alarms to be triggered. As a result, conventional photo-electric smoke detectors will not pass the requirements of Underwriter Laboratories (UL) 217-8 (residential) and 268-7 (commercial) standards. These standards require smoke detectors be configured to not sound an alarm until after a certain threshold during the "broiling hamburger" test, but before a certain threshold during the "flaming foam fire" test.

Accordingly, there remains a need for a smoke detector, and method of operating such smoke detector, that satisfies the requirements of UL 217-8 and 268-7 standards with reduced complexity and lower costs than existing smoke detectors that are capable of satisfying the requirements of UL 217-8 and 268-7.

BRIEF DESCRIPTION

According to one embodiment, a smoke detector is provided, which includes a housing, an emitter, a receiver, and a controller. The housing has a chamber for receiving ambient materials. The emitter is configured to emit light into the chamber. The receiver is configured to receive light reflected from the ambient materials in the chamber and generate output signals. An angular distance between the emitter and the receiver is less than 90°. The angular distance between the emitter and the receiver generates a back scatter effect. The controller is configured to receive output signals from the receiver and determine whether a current condition of the chamber indicates a need to trigger an alarm. The smoke detector includes only one emitter and only one receiver.

In accordance with additional or alternative embodiments, the controller determines whether the current condition is a fast fire, or a slow fire.

In accordance with additional or alternative embodiments, the ambient materials include air and smoke and non-smoke particles carried by the air.

In accordance with additional or alternative embodiments, the controller monitors a time increment between a first output signal threshold and a second output signal threshold to determine whether a current condition of the chamber indicates a need to trigger an alarm.

In accordance with additional or alternative embodiments, the first output signal threshold is 0.5 percent obscuration per foot (% obs/ft.) and the second output signal threshold is 1.25% obs/ft.

In accordance with additional or alternative embodiments, when the time increment is less than sixty (60) seconds, the controller triggers an alarm when an output signal of 1.5% obs/ft. is received. This time increment may suggest the current condition is a fast fire.

In accordance with additional or alternative embodiments, when the time increment is greater than sixty (60) seconds, the controller triggers an alarm when an output signal of 2.0% obs/ft. is received. This time increment may suggest the current condition is a slow fire.

In accordance with additional or alternative embodiments, the controller is configured to determine whether the current condition of the chamber indicates a need to trigger an alarm in satisfaction of UL 217-8 requirements.

In accordance with additional or alternative embodiments, the controller is configured to determine whether the current condition of the chamber indicates a need to trigger an alarm in satisfaction of UL 268-7 requirements.

According to another aspect of the disclosure, a method for operating a smoke detector is provided. The smoke detector may include a housing defining a chamber, an emitter configured to emit light, and a receiver configured to receive light. An angular distance between the emitter and the receiver, in certain instances, is less than 90°. The angular distance between the emitter and the receiver, when being less than 90°, generates a back scatter effect. The smoke detector, in certain instances, includes only one emitter and only one receiver. The method includes receiving, from the receiver at a controller, output signals resulting from light emitted into the chamber by the emitter, the light being reflected toward the receiver by ambient materials in the chamber, and determining, in the controller, whether a current condition of the chamber indicates a need to trigger an alarm based on a time increment between a first output signal threshold and a second output signal threshold.

In accordance with additional or alternative embodiments, the controller determines whether the current condition is a fast fire, or a slow fire based on the time increment.

In accordance with additional or alternative embodiments, the first output signal threshold is 0.5 percent obscuration per foot (% obs/ft.) and the second output signal threshold is 1.25% obs/ft.

In accordance with additional or alternative embodiments, the method further includes triggering an alarm when the time increment is less than sixty (60) seconds, when an output signal of 1.5% obs/ft. is received by the controller. This time increment may suggest the current condition is a fast fire.

In accordance with additional or alternative embodiments, the method further includes triggering an alarm when the time increment is greater than sixty (60) seconds, when an output signal of 2.0% obs/ft. is received by the controller. This time increment may suggest the current condition is a slow fire.

In accordance with additional or alternative embodiments, the determining satisfies UL 217-8 requirements.

In accordance with additional or alternative embodiments, the determining satisfies UL 268-7 requirements.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

Underwriter Laboratories (UL) 217-8 (residential) and 268-7 (commercial) standards require smoke detectors be configured to not sound an alarm until after a certain threshold (1.5% obs/ft.) during the "broiling hamburger" test, but before a certain threshold (5% obs/ft.) during the "flaming foam fire" test. To meet these requirements smoke detectors have been designed, which include multiple emitters configured to emit multiple kinds of light at various angles to one or more receivers, generating a combination of infrared forward scatter, infrared back scatter, and blue forward scatter. These detectors are sometimes referred to as "multi-wave, multi-angle smoke detectors". To reduce the cost and complexity of the smoke detector while maintaining the ability of meeting UL 217-8 and UL 268-7 requirements, a photo-electric smoke detector with a single emitter and single receiver configured with an angular distance between the emitter and receiver of less than 90° is provided.

This angular distance, in one configuration, is measured, in a clockwise fashion, from a receiving axis extending from the receiver to an emitting axis extending from the emitter. However, if the emitter and receiver are switched, as can be done in another configuration, the angular distance is measured, in a clockwise fashion, from an emitting axis extending from the emitter to a receiving axis extending from the receiver. In either configuration, the angular distance between the emitter and receiver is less than 90°.

The angular distance between the emitter and receiver generates a back scatter effect. By generating a back scatter effect, the smoke detector reduces the detection of smaller particles produced during the "broiling hamburger" test. This is because the small size particles produced during the "broiling hamburger" test generate a strong forward scatter signal and a weak back scatter signal. By reducing the detection of the smaller particles produced during the "broiling hamburger" test, more accurate readings of the larger particles produced during the "flaming foam fire" test and other real-world hazardous fires are possible. In certain instances, the smoke detector increases (i.e. amplifies) the amount of light emitted by the emitter to enable the detection of large particles. In certain instances, the type of light emitted by the emitter is an infrared light or any light in the visible spectrum, such as blue light.

Figure 1:
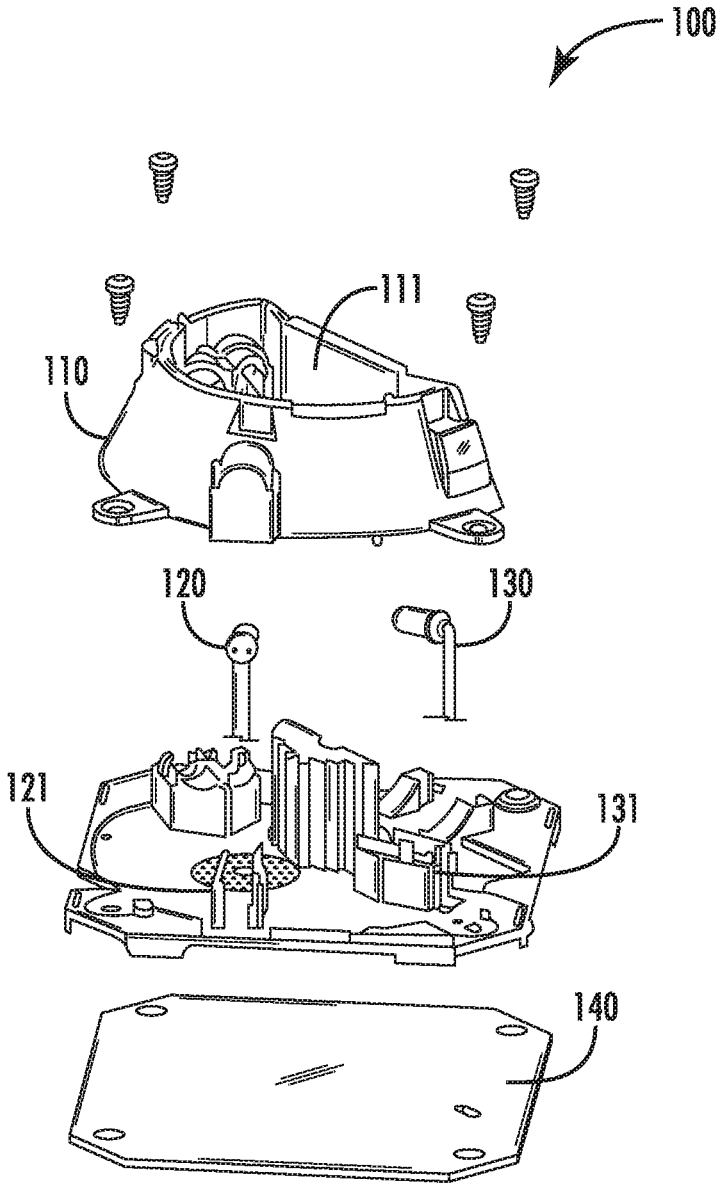
FIG. 1 is an exploded view of a smoke detector in accordance with one aspect of the disclosure.

With reference now to the Figures, a smoke detector 100, in accordance with various aspects of the disclosure is shown in FIG. 1. The smoke detector 100 may, in certain instances, be referred to as a "detector". Although described herein to be used to detect smoke, the detector 100, may, in certain instances, be used to detect other constituents capable of entering the detector 100 (ex. carbon monoxide). When used to detect smoke, the smoke detector 100 is capable of detecting when ambient materials, such as air and smoke and non-smoke particles carried by the air, enter the smoke detector 100. The smoke detector 100, in certain instances, is a photo-electric smoke detector.

As shown in FIG. 1, the smoke detector 100 includes a housing 110 defining a chamber 111 for receiving ambient materials, an emitter 120 configured to emit light into the chamber 111, a receiver 130 configured to receive light reflected from the ambient materials in the chamber 111 and generate output signals, a controller 140 configured to receive output signals from the receiver 130 and determine whether a current condition of the chamber 111 indicates a need to trigger an alarm.

The output signals sent to the controller 140 by the receiver 130, in certain instances, indicate an intensity of the light the receiver 130 receives. The output signals sent to the controller 140 by the receiver 130, in certain instances, do not detect a difference in wavelength between the light emitted by the emitter 120 and the light received by the receiver 130. The chamber 111 is generally open to the surroundings of the smoke detector 100 so that the ambient materials can enter the chamber 111 through a grating or other similar feature. The receiver 130 may be any suitable photo-electric light receiving element capable of receiving light reflected from the ambient materials in the chamber 111. The emitter 120 may be any suitable light emitting diode (LED) capable of emitting light (ex. infrared or any light in the visible spectrum, such as blue light) into the chamber 111. The emitter 120, in certain instances, is secured by an emitter housing 121. The receiver 130, in certain instances, is secured by a receiver housing 131. In other instances, the emitter 120 and the receiver 130 may not be secured using housings. The smoke detector 100, in certain instances, includes only one emitter 120 and only one receiver 130.

The controller 140, in certain instances, may be on a printed circuit board (PCB) which mechanically supports and communicatively connects components using conductive tracks, pads, or other features etched from one or more layers of copper onto and/or between one or more non-conductive sheets. In other instances, the controller 140 may not be on a PCB, but instead may be on any suitable substrate capable of supporting the components of the controller 140.

Figure 2:
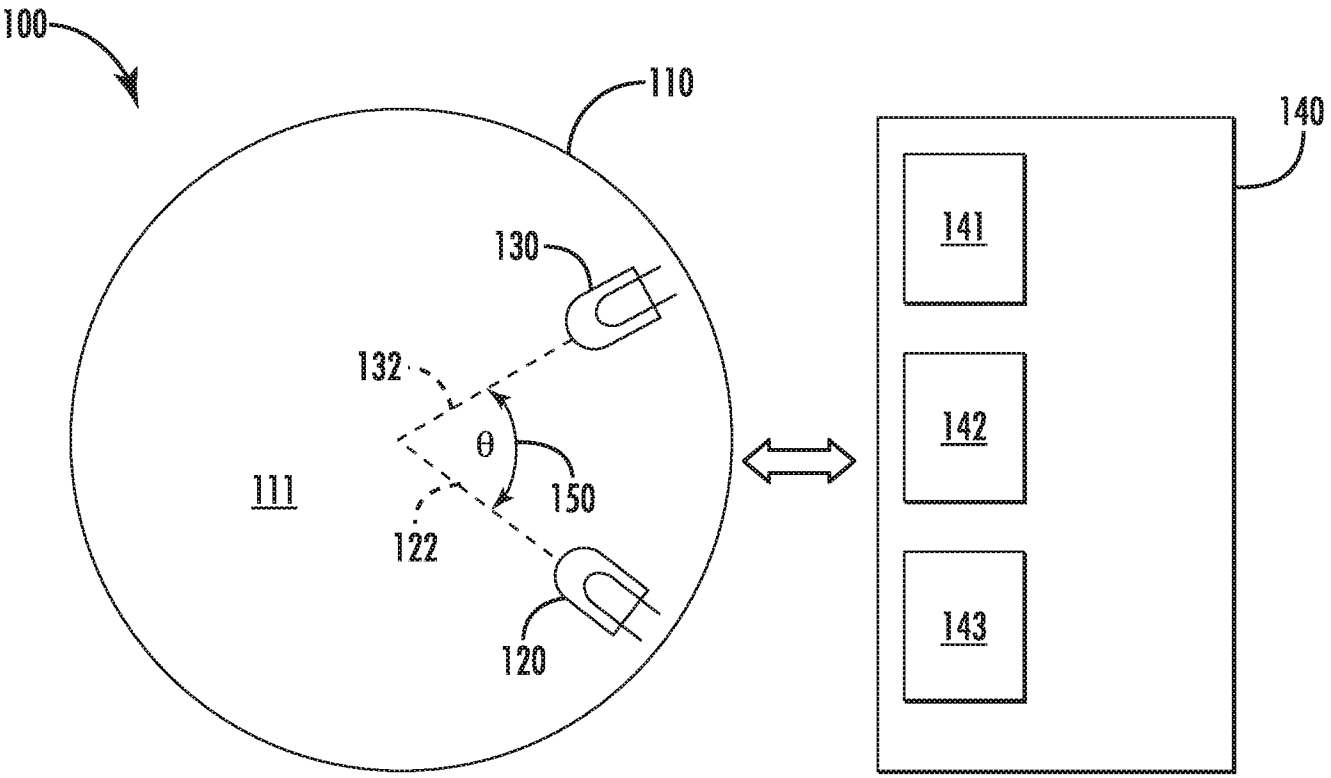
FIG. 2 is a perspective view of a smoke detector in accordance with one aspect of the disclosure.

The controller 140, as shown in FIG. 2, may include a receiver controlling component 141 operatively coupled with the receiver 130 for controlling the operation of the receiver 130, an alarm processing component 142 communicatively coupled with the receiver 130 to receive output signals from receiver 130 and complete the determination of whether or not to trigger an alarm, and an emitter controlling component 143 operatively coupled with the emitter 120 for controlling the operation of the emitter 120. Although described herein to include a receiver controlling component 141, an alarm processing component 142, and an emitter controlling component 143, in certain instances, one or more components may or may not be combined and/or not included. The controller 140, in certain instances, through the emitter controlling component 143, may increase (i.e. amplify) the amount of light emitted by the emitter 120 to enable the detection of large particles by the smoke detector 100. The controller 140, in certain instances, through the alarm processing component 142 is capable of determining whether or not to trigger an alarm based on whether the current condition indicates a fast fire or a slow fire. The alarm processing component 142 of the controller 140, in certain instances, makes this determination, at least in part, based on the intensity of the light the receiver 130 receives.

As shown in FIG. 2, the angular distance 150 between the emitter 120 and the receiver 130 is less than 90°. The angular distance 150 in the configuration shown in FIG. 2 is measured, in a clockwise fashion, from a receiving axis 132 extending from the receiver 130 to an emitting axis 122 extending from the emitter 120. Although not independently shown, it is envisioned that the emitter 120 and the receiver 130 can be switched in terms of position, placing the emitter 120 in the position of the receiver 130 and the receiver 130 in the position of the emitter 120. If switched, the angular distance 150 is measured, in a clockwise fashion, from an emitting axis 122 extending from the emitter 120 to a receiving axis 132 extending from the receiver 130. In either configuration, the angular distance 150 between the emitter 120 and receiver 130 is less than 90°.

Figure 4:
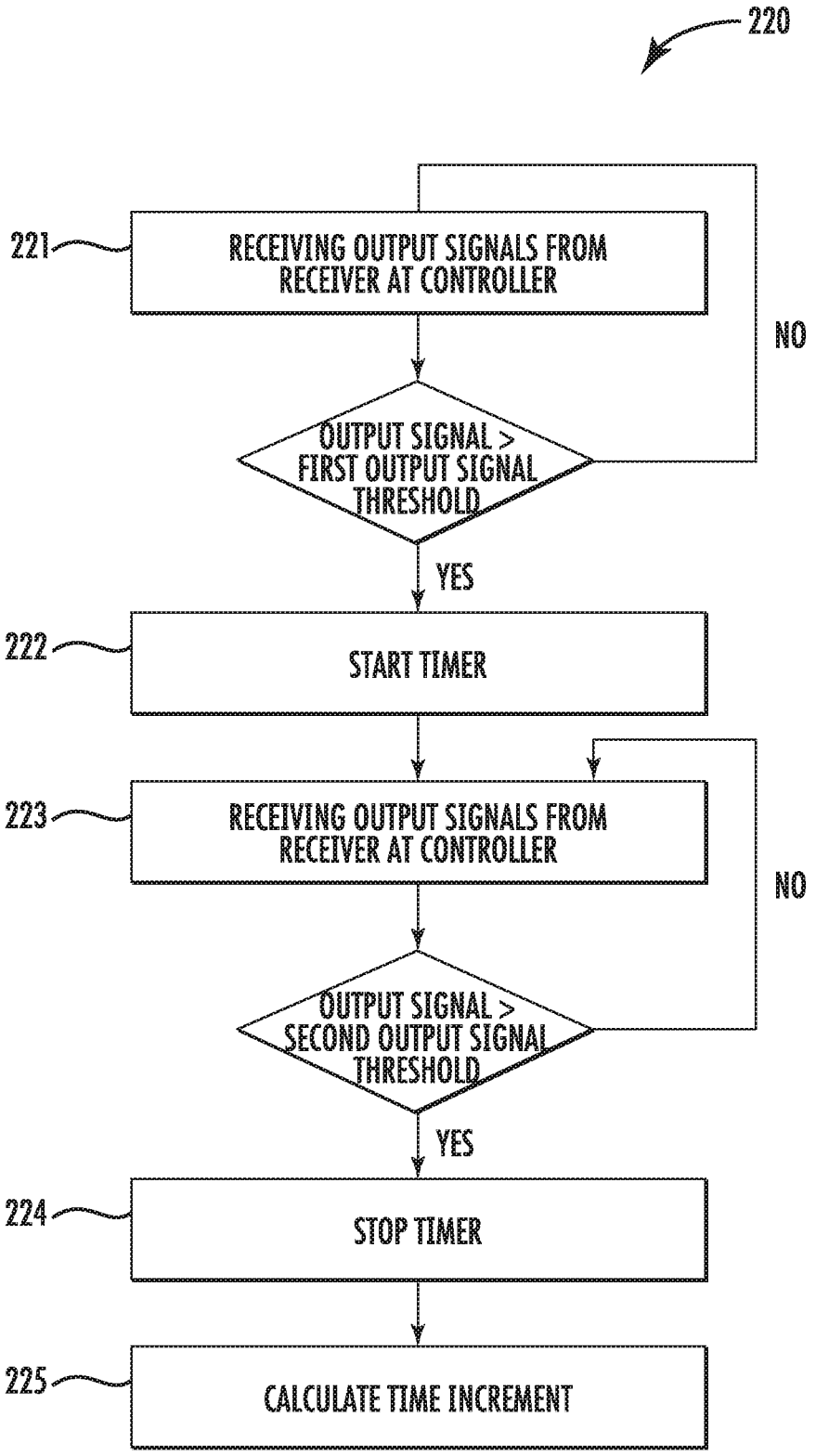
FIG. 4 is a flow diagram illustrating a calculation of a time increment in accordance with one aspect of the disclosure.

The angular distance 150 between the emitter 120 and the receiver 130 generates a back scatter effect. The back scatter effect helps to minimize the detection of the smaller particles produced during the "broiling hamburger" test, while still being able to detect the large particles produced during the "flaming foam fire" test. When detecting the particles, the receiver 130 generates output signals which are sent to the controller 140. The controller 140 is configured to determine whether a current condition of the chamber 111 indicates a need to trigger an alarm by monitoring a time increment between a first output signal threshold and a second output signal threshold, as shown in FIG. 4.

In certain instances, the first output signal threshold is 0.5 percent obscuration per foot (% obs/ft.) and the second output signal threshold is 1.25% obs/ft. The first output signal threshold may, in certain instances, be between 0.2% obs/ft. and 0.8% obs/ft. For example, the first output signal threshold may, in certain instances, be between 0.2% obs/ft. and 0.4% obs/ft., between 0.2% obs/ft. and 0.6% obs/ft., between 0.4% obs/ft. and 0.6% obs/ft., between 0.4% obs/ft. and 0.8% obs/ft., or between 0.6% obs/ft. and 0.8% obs/ft. The second output signal threshold may, in certain instances, be between 1.0% obs/ft. and 1.5% obs/ft. For example, the second output signal threshold may, in certain instances, be between 1.0% obs/ft. and 1.2% obs/ft., between 1.0% obs/ft. and 1.4% obs/ft., between 1.2% obs/ft. and 1.4% obs/ft., between 1.2% obs/ft. and 1.5% obs/ft., or between 1.4% obs/ft. and 1.5% obs/ft.

The controller 140, in certain instances, triggers an alarm at different thresholds depending on the time increment between the first output signal threshold and the second output signal threshold. When the time increment is less than sixty (60) seconds, in certain instances, the controller 140 triggers an alarm when an output signal of 1.5% obs/ft. is received. A time increment of less than sixty (60) seconds may suggest that the current condition is a fast fire. When the time increment is greater than sixty (60) seconds, in certain instances, the controller 140 triggers an alarm when an output signal of 2.0% obs/ft. is received. A time increment of greater than sixty (60) seconds may suggest that the current condition is a slow fire. The components of the smoke detector 100 and method of which the smoke detector is operated, enables the differentiation between fast fires or slow fires, making the smoke detector 100 compliant with UL 217-8 and 268-7 standards.

Figure 3:
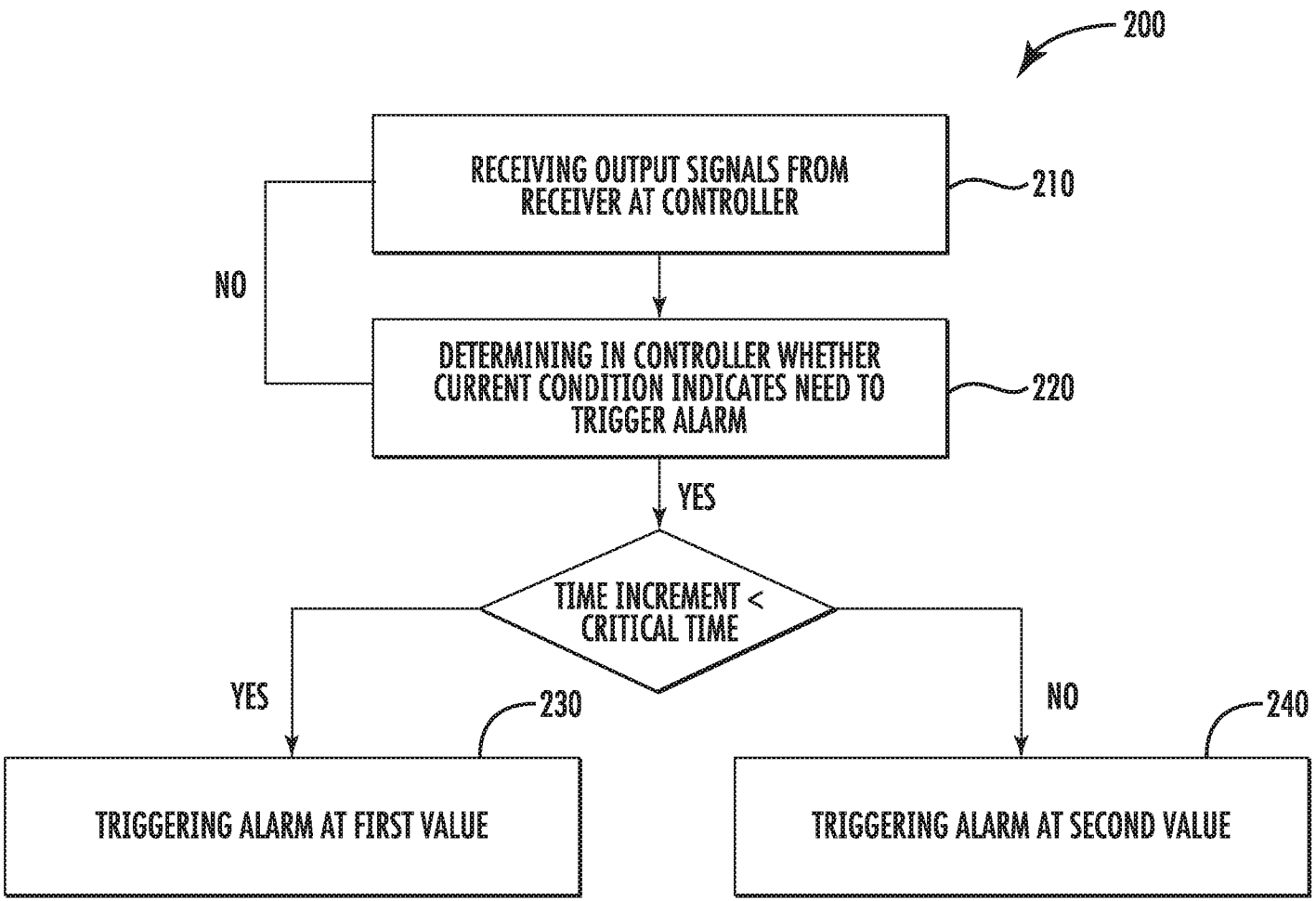
FIG. 3 is a flow diagram illustrating a method for operating a smoke detector in accordance with one aspect of the disclosure.

The method 200 of operating the smoke detector 100 is illustrated in FIG. 3. The method 200 may be done, for example, using exemplary smoke detector 100, as shown in FIG. 1 and FIG. 2, which includes a housing 110 defining a chamber 111, an emitter 120 configured to emit light, a receiver 130 configured to receive light, an angular distance 150 between the emitter 120 and the receiver 130 being less than 90°, the angular distance between the emitter 120 and the receiver 130 generating a back scatter effect, and a controller in communication with the receiver 130. The smoke detector 100, in certain instances, includes only one emitter 120 and only one receiver 130.

Figure 5:
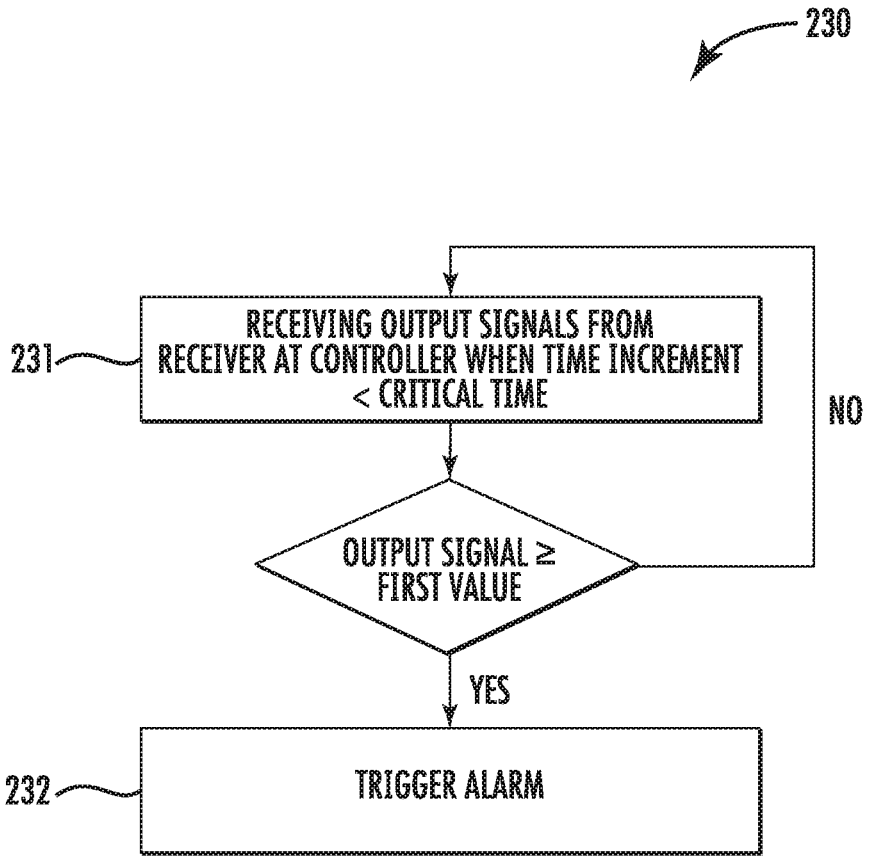
FIG. 5 is a flow diagram illustrating the triggering of an alarm for a fast fire in accordance with one aspect of the disclosure.
Figure 6:
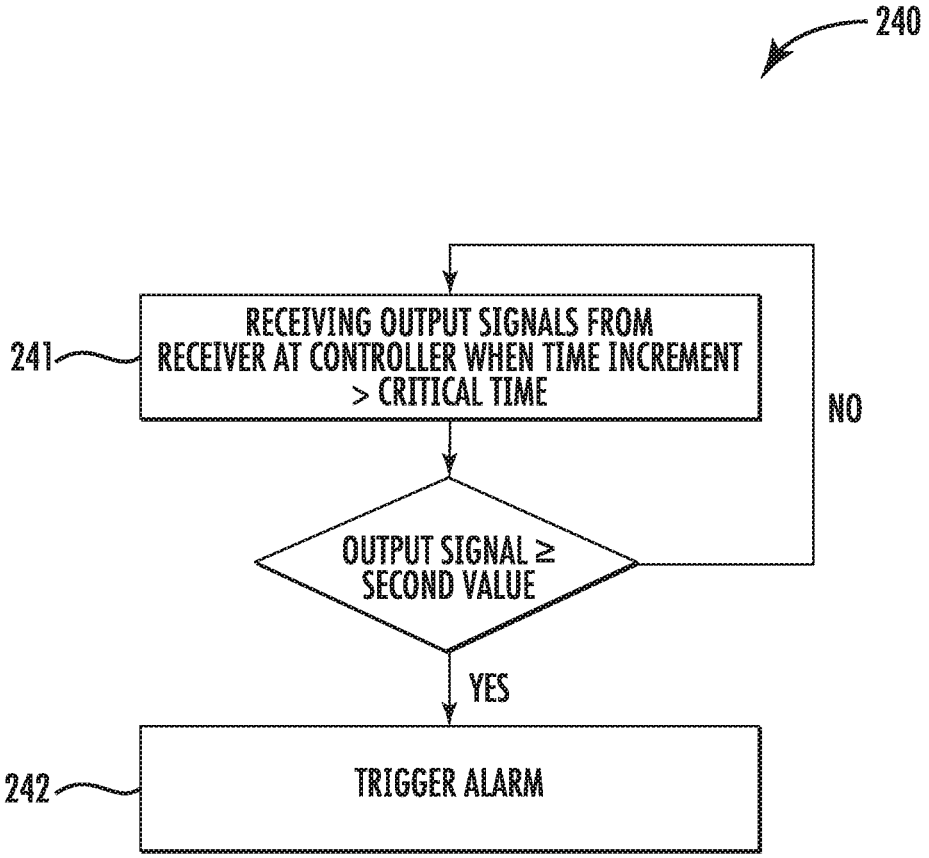
FIG. 6 is a flow diagram illustrating the triggering of an alarm for a slow fire in accordance with one aspect of the disclosure.

For purposes of clarity, the method 200, as shown in FIG. 3, has been broken down into multiple independent figures (FIGS. 4-6). FIG. 4 is provided to illustrate the calculation of a time increment, which is part of the determining step 220 shown in FIG. 3. FIG. 5 is provided to illustrate the triggering of an alarm for a fast fire 230, as shown in FIG. 3. FIG. 6 is provided illustrate the triggering of an alarm for a slow fire 240, as shown in FIG. 3.

As shown in FIG. 3, the method 200 includes step 210 of receiving, from the receiver 130 at a controller 140, output signals resulting from light emitted into the chamber 111 by the emitter 120, the light being reflected toward the receiver 130 by ambient materials in the chamber 111. Instead of calculating different output signal ratios, as is done by existing multi-wave, multi-angle smoke detectors, the method 200 determines, in step 220, in the controller 140, whether a current condition of the chamber 111 indicates a need to trigger an alarm based on a time increment between a first output signal threshold and a second output signal threshold. In certain instances, the first output signal threshold is 0.5% obs/ft. and the second output signal threshold is 1.25% obs/ft.

If step 220 indicates that there is not a need to trigger an alarm, then the method 200 reverts back to step 210. If step 220 indicates a need to trigger an alarm, then the method 200 provides for the triggering of an alarm at different values dependent on the whether the current condition is a fast fire or a slow fire. As shown in FIG. 3, if the time increment is less than a critical time (i.e. the current condition is a fast fire) then the alarm is triggered at a first value. If the time increment is greater than a critical time (i.e. the current condition is a slow fire) then the alarm is triggered at a second value.

The calculation of this time increment 220, as part of the determining step 220, in accordance with one aspect of the disclosure, is shown in FIG. 4. The calculation of the time increment includes step 221 of receiving output signals from the receiver 130 at the controller 140. If the output signal received by the controller 140 is greater than the first output signal threshold then a timer is started 222 in the controller 140. If the output signal received by the controller 140 is less than the first output signal threshold then the timer is not started. In certain instances, the controller 140 continuously receives output signals from the receiver 130 to ensure timely starting the timer. Continuously receiving may, in certain instances, be achieved by receiving an output signal from the receiver 130 at the controller 140 within every second. Continuously receiving may, in certain instances, be achieved by constantly sending output signals from the receiver 130 to the controller 140.

Once the timer is started 222 in the controller 140, the timer is stopped 224 once an output signal greater than a second output signal threshold is received from the receiver 130 at the controller 140. The calculation of the time increment includes step 223 of receiving output signals from the receiver 130 at the controller 140, to ensure that the timer is timely stopped. The difference between step 221 and step 223 is that step 221 is used to start the timer 222, whereas step 223 is used to stop the timer 224. Like step 221, in step 223, the controller 140 may continuously receive output signals from the receiver 130 to ensure timely stopping of the timer. Once the timer is stopped, the controller 140 calculates the time increment 225, which is the amount of time that elapses between the starting of the timer 222 and the stopping of the timer 224.

The controller 140, in certain instances, uses this time increment to determine whether the current condition is a fast fire or a slow fire. If the time increment indicates that the current condition is a fast fire, the controller 140 triggers an alarm when a received output signal is greater than or equal to a first value. If the time increment indicates that the current condition is a slow fire, the controller 140 triggers an alarm when a received output signal is greater than or equal to a second value. The output signal at which the controller 140 triggers an alarm for a fast fire, in certain instances, is different from the output signal at which the controller 140 triggers an alarm for a slow fire.

The triggering of an alarm for a fast fire 230 is shown in FIG. 5. The triggering of an alarm for a fast fire 230 includes step 231 of receiving output signals from the receiver 130 at a controller 140 when the time increment is less than a critical time. A critical time less than sixty (60) seconds, in certain instances, indicates that the current condition is a fast fire. Once determined to be a fast fire by the controller 140, the controller 140 triggers an alarm when an output signal of greater than or equal to a first value is received by the controller 140 from the receiver 130. This first value, in certain instances, is 1.5% obs/ft. To ensure that the alarm is triggered timely, the controller 140 may continuously receive output signals from the receiver 130. Continuously receiving may, in certain instances, be achieved by receiving an output signal from the receiver 130 at the controller 140 within every second. Continuously receiving may, in certain instances, be achieved by constantly sending output signals from the receiver 130 to the controller 140.

The triggering of an alarm for a slow fire 240 is shown in FIG. 6. The triggering of an alarm for a slow fire 240 includes step 241 of receiving output signals from the receiver at a controller 140 when the time increment is greater than a critical time. A critical time greater than sixty (60) seconds, in certain instances, indicates that the current condition is a slow fire. Once determined to be a slow fire by the controller 140, the controller 140 triggers an alarm when an output signal of greater than or equal to a second value is received by the controller 140 from the receiver 130. This second value, in certain instances, is 2.0% obs/ft. Like the triggering of an alarm for a fast fire 230, the triggering of an alarm for a slow fire 240 may provide for the continuous receiving of output signals from the receiver 130 at the controller 140 to ensure the timely triggering of the alarm.

The critical time may, in certain instances, be between ten (10) and sixty (60) seconds. For example, the critical time for determining whether the current condition is a fast fire or a slow fire may, in certain instances, be between ten (10) and thirty (30) seconds. In certain instances, the critical time is between ten (10) and fifty (50) seconds, between ten (10) and forty (40) seconds, between ten (10) and thirty (30) seconds, between ten (10) and twenty (20) seconds, between twenty (20) and sixty (60) seconds, between twenty (20) and fifty (50) seconds, between twenty (20) and forty (40) seconds, between twenty (20) and thirty (30) seconds, between thirty (30) and sixty (60) seconds, between thirty (30) and fifty (50) seconds, between thirty (30) and forty (40) seconds, between forty (40) and sixty (60) seconds, between forty (40) and fifty (50) seconds, or between fifty (50) and sixty (60) seconds. In certain instances, the critical time is ten (10) seconds.

By triggering the alarm at different thresholds for fast fires and slow fires, the method 200 for operating the smoke detector 100 satisfies the requirements of UL 217-8 and 268-7 standards. However, without generating a back scatter effect, which is caused by the angular distance 150 between the emitter 120 and the receiver 130 in the smoke detector 100, the smoke detector 100 would not be able to obtain accurate readings to meet these standards. The accuracy of these readings is critical because the determination of when to trigger an alarm is dependent on the readings. The method 200 provided herein, using this particularly configured smoke detector 100, ensures that an alarm is not sounded until after the required threshold of 1.5% obs/ft. during the "broiling hamburger" test, but before the required threshold of 5% obs/ft. during the "flaming foam fire" test.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A smoke detector, comprising:

a housing defining a chamber for receiving ambient materials;

an emitter configured to emit light into the chamber;

a receiver configured to receive light reflected from the ambient materials in the chamber and generate output signals, an angular distance between the emitter and the receiver is less than 90°, wherein the angular distance between the emitter and the receiver generates a back scatter effect; and a controller configured to receive output signals from the receiver and determine whether a current condition of the chamber indicates a need to trigger an alarm, wherein the controller monitors a time increment between a first output signal threshold and a second output signal threshold to determine whether a current condition of the chamber indicates a need to trigger an alarm, wherein the smoke detector comprises only one emitter and only one receiver, wherein when the time increment is less than sixty (60) seconds, the controller triggers an alarm when an output signal of greater than or equal to 1.5% obs/ft. is received, wherein when the time increment is greater than sixty (60) seconds, the controller triggers an alarm when an output signal of greater than or equal to 2.0% obs/ft. is received.

2. The smoke detector of claim 1, wherein the controller determines whether the current condition is a fast fire, or a slow fire.

3. The smoke detector of claim 1, wherein the ambient materials comprise air and smoke and non-smoke particles carried by the air.

4. The smoke detector of claim 1, wherein the first output signal threshold is 0.5 percent obscuration per foot (% obs/ft.) and the second output signal threshold is 1.25% obs/ft.

5. The smoke detector of claim 1, wherein when the time increment is less than sixty (60) seconds the time increment suggests the current condition is a fast fire.

6. The smoke detector of claim 1, wherein when the time increment is greater than sixty (60) seconds the time increment suggests the current condition is a slow fire.

7. The smoke detector of claim 1, wherein the controller is configured to determine whether the current condition of the chamber indicates a need to trigger an alarm in satisfaction of UL 217-8 requirements.

8. The smoke detector of claim 1, wherein the controller is configured to determine whether the current condition of the chamber indicates a need to trigger an alarm in satisfaction of UL 268-7 requirements.

9. A method for operating a smoke detector comprising a housing defining a chamber, an emitter configured to emit light, and a receiver configured to receive light, an angular distance between the emitter and the receiver is less than 90°, the angular distance between the emitter and the receiver generating a back scatter effect, wherein the smoke detector comprises only one emitter and only one receiver, the method comprising receiving, from the receiver at a controller, output signals resulting from light emitted into the chamber by the emitter, the light being reflected toward the receiver by ambient materials in the chamber; and determining, in the controller, whether a current condition of the chamber indicates a need to trigger an alarm based on a time increment between a first output signal threshold and a second output signal threshold, wherein when the time increment is less than sixty (60 seconds, the controller triggers an alarm when an output signal of greater than or equal to 1.5% obs/ft. is received, wherein when the time increment is greater than sixty (60) seconds, the controller (140) triggers an alarm when an output signal of greater than or equal to 2.0% obs/ft. is received.

10. The method of claim 9, wherein the controller determines whether the current condition is a fast fire, or a slow fire based on the time increment.

11. The method of claim 9, wherein the first output signal threshold is 0.5 percent obscuration per foot (% obs/ft.) and the second output signal threshold is 1.25% obs/ft.

12. The method of claim 9, wherein when the time increment is less than (60) seconds the time increment suggests the current condition is a fast fire.

13. The method of claim 9, wherein when the time increment is greater than sixty (60) seconds the time increment suggests the current condition is a slow fire.

14. The method of claim 9, wherein the determining satisfies UL 217-8 requirements.

15. The method of claim 9, wherein the determining satisfies UL 268-7 requirements.

* * * * *